US007288892B2

(12) United States Patent
Inan et al.

(10) Patent No.: US 7,288,892 B2
(45) Date of Patent: Oct. 30, 2007

(54) PLASMA DISPLAY PANEL WITH IMPROVED CELL GEOMETRY

(75) Inventors: Umran S. Inan, Mountain View, CA (US); Georgios Veronis, Mountain View, CA (US)

(73) Assignee: Board of Trustees of the Leland Stanford Junior University, Stanford, CA (US)

( * ) Notice: Subject to any disclaimer, the term of this patent is extended or adjusted under 35 U.S.C. 154(b) by 413 days.

(21) Appl. No.: 10/386,279

(22) Filed: Mar. 10, 2003

(65) Prior Publication Data

US 2003/0173900 A1 Sep. 18, 2003

Related U.S. Application Data

(60) Provisional application No. 60/364,401, filed on Mar. 12, 2002.

(51) Int. Cl.
*H01J 17/49* (2006.01)

(52) U.S. Cl. ..... 313/586; 313/587; 313/582; 313/584

(58) Field of Classification Search ..... 313/582–587, 313/483–485, 491, 514, 517, 518, 621, 631
See application file for complete search history.

(56) References Cited

U.S. PATENT DOCUMENTS

| | | | | |
|---|---|---|---|---|
| 5,742,122 | A * | 4/1998 | Amemiya et al. | 313/582 |
| 5,789,862 | A | 8/1998 | Makino | |
| 6,246,171 | B1 * | 6/2001 | Vollkommer et al. | 313/586 |
| 6,252,353 | B1 | 6/2001 | Ha et al. | |
| 6,333,599 | B1 | 12/2001 | Kawanami et al. | |
| 6,407,509 | B1 * | 6/2002 | Ikeda et al. | 315/169.4 |
| 6,476,554 | B1 * | 11/2002 | Snijkers et al. | 313/586 |
| 6,555,956 | B1 * | 4/2003 | Kim | 313/582 |
| 2003/0042855 | A1 * | 3/2003 | Chien et al. | 313/586 |
| 2003/0127981 | A1 * | 7/2003 | Otani et al. | 313/582 |
| 2005/0110408 | A1 * | 5/2005 | Jang et al. | 313/582 |

FOREIGN PATENT DOCUMENTS

| | | | |
|---|---|---|---|
| JP | 05234520 | A * | 9/1993 |
| JP | 11007893 | A * | 1/1999 |
| JP | 2001256892 | A * | 9/2001 |
| JP | 2003051262 | A * | 2/2003 |

OTHER PUBLICATIONS

C.H. Son, J.K. Lee, H.C. Kim, S. Dastgeer, S.S. Yang and S.W. Shin, "P-57: Striation Phenomenon of Plasma Display Panel (PDP) Cell and Its Application to Efficiency Improvement", SID 01 Digest, Dept. of Electrical Engineering, Pohang University of Science and Technology, Pohang, 790-784, S. Korea, pp. 767-769.

* cited by examiner

*Primary Examiner*—Mariceli Santiago
(74) *Attorney, Agent, or Firm*—Perkins Coie LLP

(57) ABSTRACT

A cell geometry for a coplanar electrode plasma display panel consisting of two transparent plates, one with parallel sustain electrodes, and the other with address electrodes deposited on their surface. The electrodes are covered with a dielectric film. A protective MgO layer is deposited on the dielectric film adjacent the sustain electrodes. A phosphor layer is deposited on the other dielectric film. The plates are scaled together with their electrodes at right angles and the gap between the plates is filled with an inert gas mixture. The geometry of the sustain electrodes and/or associated dielectric film provides a larger equivalent capacitance at the outer part of the sustain electrodes to provide larger luminous efficiencies.

12 Claims, 8 Drawing Sheets

PLASMA DISPLAY PANEL WITH IMPROVED CELL GEOMETRY

RELATED APPLICATIONS

This application claims priority to U.S. Provisional Application Ser. No. 60/364,401 filed Mar. 12, 2002.

BRIEF DESCRIPTION OF THE INVENTION

This invention relates generally to cells of plasma display panels and more particularly to cell geometries which provide improved luminous efficiency.

BACKGROUND OF THE INVENTION

Plasma display panels (PDPs) are one of the leading candidates in the competition for large-size, high-brightness, high-contrast-ratio flat panel displays, suitable for high definition television (HDTV) wall-mounted monitors. Their advantages are high resolution, wide viewing angle, low weight, and simple manufacturing process for fabrication.

Recent progress of PDP technology development and manufacturing has been remarkable. However, there are still problems that need to be resolved to popularize the PDP as a home commodity. One of the most critical issues in ongoing PDP research is the improvement of the luminous efficiency, which is still low compared to conventional cathode ray tube displays. Another important problem is the relatively high operating voltages.

PDP cells are small (cell height is ~150 μm) and provide limited access for diagnostic measurements. As a result, experimental studies of the transient plasma discharges in PDPs are extremely difficult, and computer-based modeling is currently essential for understanding PDP physics and optimizing its operation. Computer simulations are effective in identifying the basic properties of the discharge dynamics and the dominant mechanisms of light emission. In addition, simulation models are usually successful in predicting the effects on the performance of the device of variations in design parameters, such as cell geometry, applied voltage waveforms, and gas mixture. Although simulation results are usually in qualitative rather than quantitative agreement with experimental display measurements, they are used for PDP design.

Typical color plasma displays consist of two glass plates, each with parallel electrodes deposited on their surfaces. The electrodes are covered with a dielectric film. The plates are sealed together with their electrodes at right angles, and the gap between the plates is first evacuated and then filled with an inert gas mixture. A protective MgO layer is deposited above the dielectric film. The primary role of this layer is to decrease the breakdown voltage due to the high secondary-electron emission coefficient of MgO. The UV photons emitted by the discharge hit the phosphors deposited on the walls of the PDP cell and are converted into visible photons. Each cell contains a specific type of phosphor that emits one primary color, red, green or blue.

The most common type of color plasma display is the coplanar-electrode PDP. Referring to FIG. 1 a prior art coplanar display is shown. In this PDP type each cell is formed by the intersection of a pair of transparent sustain electrodes 12, 13 on the front plate 14, and an address electrode 16 on the back plate 17. Dielectric layers 18 and 19 cover the electrodes. The dielectric film 18 is protected by MgO layer 21. A phosphor layer 22 is deposited above the dielectric film 19. Walls 23 define its various cells.

During operation, a periodic voltage with a frequency of 50-350 kHz is continuously applied between each pair of sustain electrodes. The amplitude of the sustain voltage is below the breakdown voltage. A cell is turned ON by applying a write voltage pulse between the address electrode and one of the sustain electrodes. The discharge which is initiated results in the deposition of surface charge on the dielectric layers covering these two electrodes. The superposition of the electric field induced by the deposited surface charge and of the electric field of the sustaining voltage results in the ignition of sustain discharges between the pair of sustain electrodes. The UV photons emitted by the discharge strike the phosphor layer and are converted into visible photons.

OBJECTS AND SUMMARY OF THE INVENTION

It is a general object of the present invention to provide a PDP cell design which provides increasing luminous efficiency.

It is another object of the present invention to provide a sustain electrode shape or dielectric film configuration that results in optimum luminous efficiency.

It is another object of the present invention to provide a plasma display cell geometry with larger equivalent capacitance at the outer part of the sustain electrodes to provide larger luminous efficiency.

In order to achieve the above objects a plasma display cell is provided which includes front and back plates, spaced sustaining electrodes on the front plate, a dielectric layer covering the sustain electrodes, an MgO layer on the dielectric layer, and address electrode on the back plate and a dielectric layer on the address electrode and a phosphor layer on the dielectric layer characterized in that the cell geometry is such that there is a larger equivalent capacitance at the outer part of the sustain electrodes to provide larger luminous efficiency. The larger equivalent capacitance is obtained by shaping the sustain electrodes or the dielectric layer deposited above the sustain electrodes.

BRIEF DESCRIPTION OF THE DRAWINGS

The invention will be clearly understood from the following description of the preferred embodiments when read in conjunction with the accompanying drawings in which.

DESCRIPTION OF THE PREFERRED EMBODIMENTS

Figure 1:
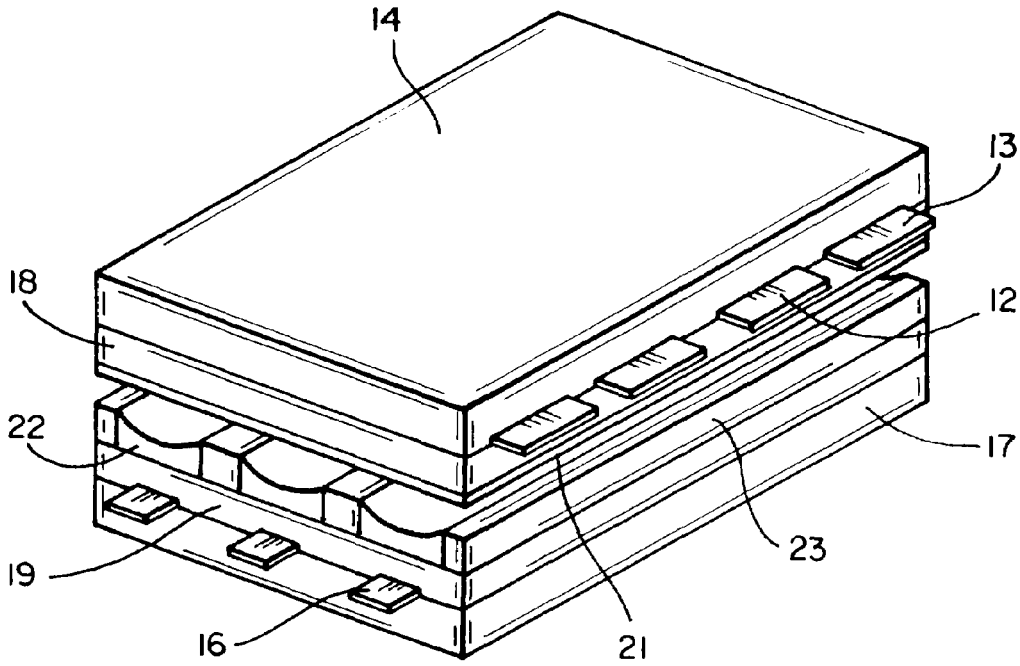
FIG 1 (PRIOR ART)
FIG. 1 is a perspective view of a plasma display panel (PDP) in accordance with the prior art.

The geometry of a standard coplanar-electrode PDP cell used in the following discussion is shown by the cross sectional view in FIG. 2. The cell consists of two sustain electrodes, 12 and 13, separated from the gas by dielectric layer 18. A MgO layer 21 is deposited on the dielectric film. The bottom of the cell consists of the address electrode 16 separated from the gas by dielectric layer 19 with a phosphor layer 22 on top. The output window of the device is the top side of the upper dielectric layer, noting that the sustain electrodes are transparent. In the following discussions the gas mixture filling the region between the dielectric layers is a Xe—Ne mixture with 4% Xe at a pressure of 500 Torr. The height and width of the cell are H=210 μm and L=1260 μm, respectively. Our reference case is characterized by the parameter values g=100 μm, w=300 μm, $d_1$=$d_2$=30 μm, and $\epsilon_r$=10, where g is the electrode gap length, w is the sustain electrode width, $d_1$, $d_2$ are the thickness of the upper and lower dielectric layers, respectively, and $\epsilon_r$ is their dielectric constant.

We use a two-dimensional (2-D) self-consistent model to simulate the microdischarges in PDP cells. The model is described in detail in Veronis and Inan J. Appl. Phys. 91, 9502 (2002).

Figure 3:
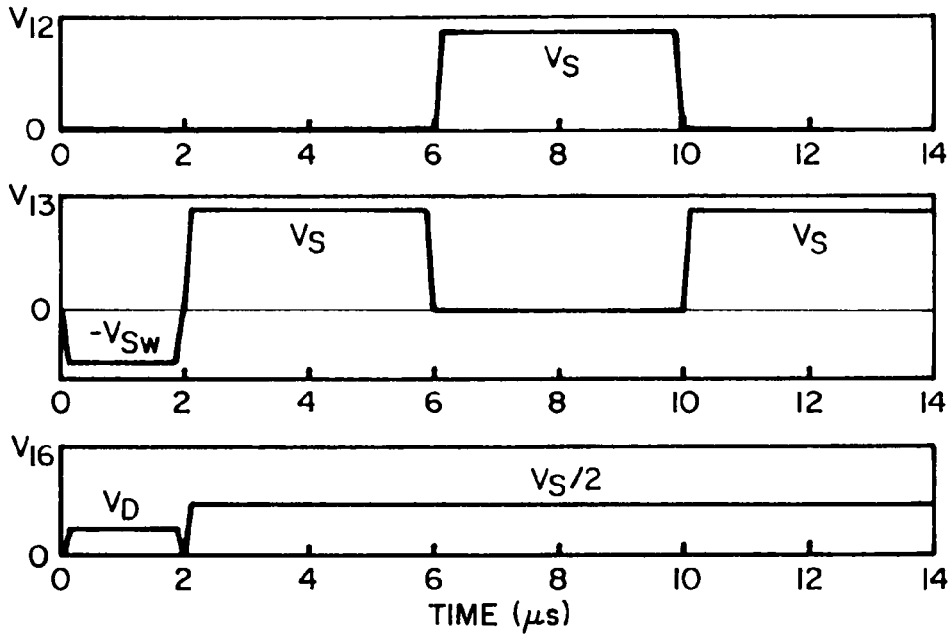
FIG. 3 shows the voltages for driving the electrodes of a PDP cell.

The voltages applied to the three electrodes during a simulation are shown in FIG. 3. Initially, data pulse $V_D$ and a base-write pulse $-V_{SW}$ are applied simultaneously to electrodes 16 and 13, respectively. These are followed by a sequence of alternating sustaining voltage pulses $V_s$ between the two sustain electrodes 12 and 13. During the sustain phase, the address electrode 16 is biased to a voltage of $V_s/2$ to prevent undesired discharges between the address electrode and the sustain electrodes. The frequency of the sustaining waveform is 125 KHz and the rise and fall times of all pulses are 100 ns. The duration of the address pulses is 2 μs.

As in Veronis and Inan ibid, we focus our attention on the operating voltages and the luminous efficiency of the PDP cell. PDP cells can operate only if the applied sustaining voltage is held within certain limits. The initial address pulse triggers a discharge between the electrodes 13 and 16. This discharge is quenched by surface charges accumulated on the dielectrics. Subsequent sustain discharges occur only in the addressed cells, since the sustaining voltage $V_S$ is below the breakdown voltage, as discussed above. The minimum sustaining voltage $V_{Smin}$ is defined as the minimum value of $V_S$ which leads to a steady sequence of sustaining discharges in an addressed cell. The firing voltage $V_f$ is defined as the breakdown voltage in an unaddressed cell. The sustaining voltage $V_S$ must at all times be less than $V_f$ in order to avoid discharges in cells which are not addressed. $V_{Smin}$ and $V_f$ define the voltage margin of the cell. In PDPs these voltages exhibit some statistical variation, since cells have slightly different dimensions. The voltage margin of the cell should therefore be as large as possible to ensure reliable operation of the display.

We investigate the effect of cell geometry design on the numerical values of $V_{Smin}$ and $V_f$. The calculation of $V_{Smin}$ and $V_f$ is done as in Veronis and Inan ibid and is repeated here for completeness. For the calculation of $V_f$ a sustain pulse $V_S$ is applied to one of the sustain electrodes and electrode 16 is biased to $V_S/2$ as described above. We use the 2-D model to iteratively calculate (to within an accuracy of one volt) the minimum voltage $V_f$ which leads to breakdown. In all cases the breakdown occurs between the two sustain electrodes.

For the calculation of $V_{Smin}$ we first apply the address pulses $V_D$ and $-V_{SW}$ described above. In all cases, we use $V_{SW}$=150V and for the reference case $V_D$=80V. In all other cases, $V_D$ is chosen so that the breakdown parameter (Y. P. Raizer, Gas Discharge Physics, Springer, Berlin, 1992, P. 131) $\mu=(\alpha_{Ne}\gamma_{Ne}+\alpha_{Xe}\gamma_{Xe})[e^{(\alpha_{Ne}+\alpha_{Xe})D}-1]/(\alpha_{Ne}+\alpha_{Ne})$ is constant, where $\alpha_{Ne}$ and $\alpha_{Xe}$ are the partial first Townsend ionization coefficients for Ne and Xe respectively, $\gamma_{Ne}$ and $\gamma_{Ne}$ are the secondary-electron emission coefficients for Ne and Xe ions respectively on MgO, and D is the discharge gap length (FIG. 2). A sequence of sustaining pulses $V_S$ is then applied between the sustain electrodes. We once again use the 2-D model (in an iterative fashion) to calculate (to within an accuracy of one volt) the minimum voltage $V_{Smin}$ which leads to a steady sequence of sustain discharges.

The UV photons which excite the phosphors are emitted by certain excited states of Xe[$Xe^*(^3P_1)$(resonant state) at 147 nm, $Xe_2^*(O_u^+)$ at 150 nm, $Xe_2^*(^3\Sigma_u^+)$ and $Xe_2^*(^1\Sigma_u^+)$ at 173 nm (excimer states)]. The excited phosphors in turn emit visible photons. We define the luminous efficiency of the cell as the ratio of total visible photon energy which reaches the output window to the total energy dissipated during a sustaining period (T=8 μs)

$$\eta = \frac{\int_T dt \int_{Sout} ds \Gamma_{ph} \varepsilon_{ph}}{\int_T dt \int_V dv \left( J_e + \sum_{i=1}^{N_{ion}} J_{ioni} \right) \cdot E}, \tag{1}$$

where $\Gamma_{ph}$ is the number of visible photons reaching the output window per unit area and per unit time, $\epsilon_{ph}$ is the visible photon energy, $J_e$ and $J_{ioni}$ are the electronic and ionic current (of ion i) respectively, and E is the electric field. We assume that the visible photon wavelength is 550 nm.

For the calculation of efficiency, the voltage waveform shown in FIG. 3 is applied in all cases to the cell electrodes. As in Veronis and Inan ibid, the sustaining voltage is chosen to be the mid-margin voltage, defined as $V_{Sm}=(V_{Smin}+V_f)/2$. The mid-margin voltage is usually chosen as the point of operation of the PDP to ensure reliability. We calculate the efficiency of the PDP cell in the periodic steady state, typically involving the application of at least 5 sustaining pulses.

Figure 4:
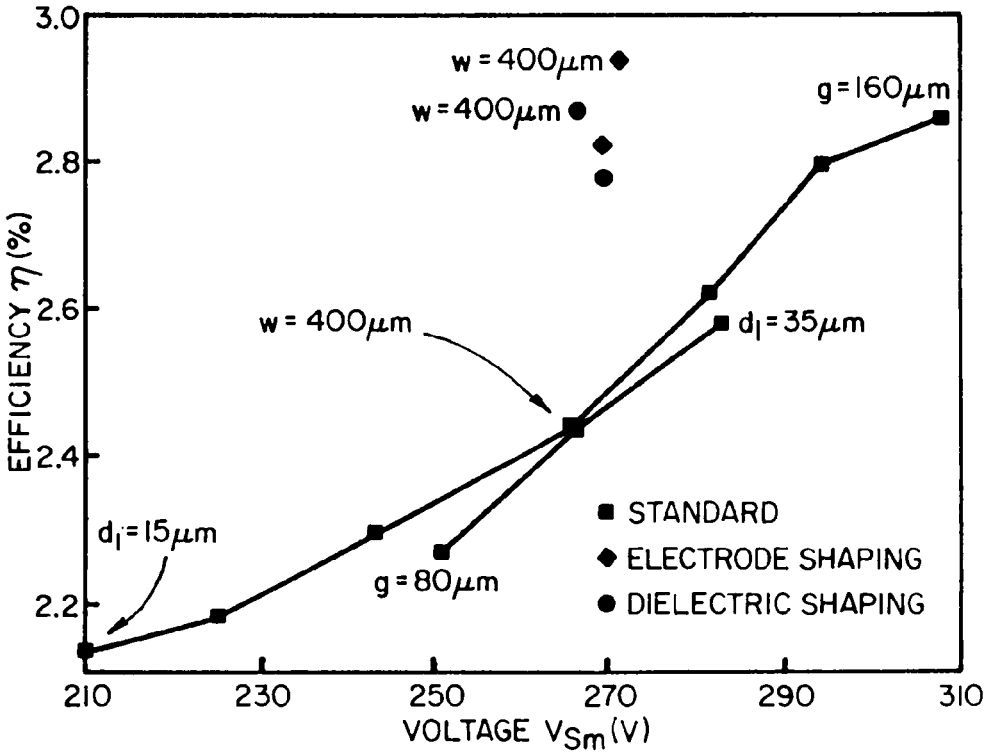
FIG. 4 shows luminous efficiency and mid-margin voltages for various PDP cell designs.

In the standard coplanar-electrode geometry there is a trade-off between high luminous efficiency and low operating voltages. In FIG. 4 we show the effect of the variation of the sustain electrode gap length g (FIG. 2) on the luminous efficiency $\eta$ and the mid-margin voltage $V_{Sm}$ of the PDP cell. We observe that larger values of g result in larger values of both $\eta$ and $V_{Sm}$. Similarly, larger values of the length of the upper dielectric $d_1$ (FIG. 2) results in larger values of both $\eta$ and $V_{Sm}$. FIG. 4, also shows the luminous efficiency $\eta$ and mid-margin voltage $V_{Sm}$ for alternative cell geometry designs.

Figure 5:
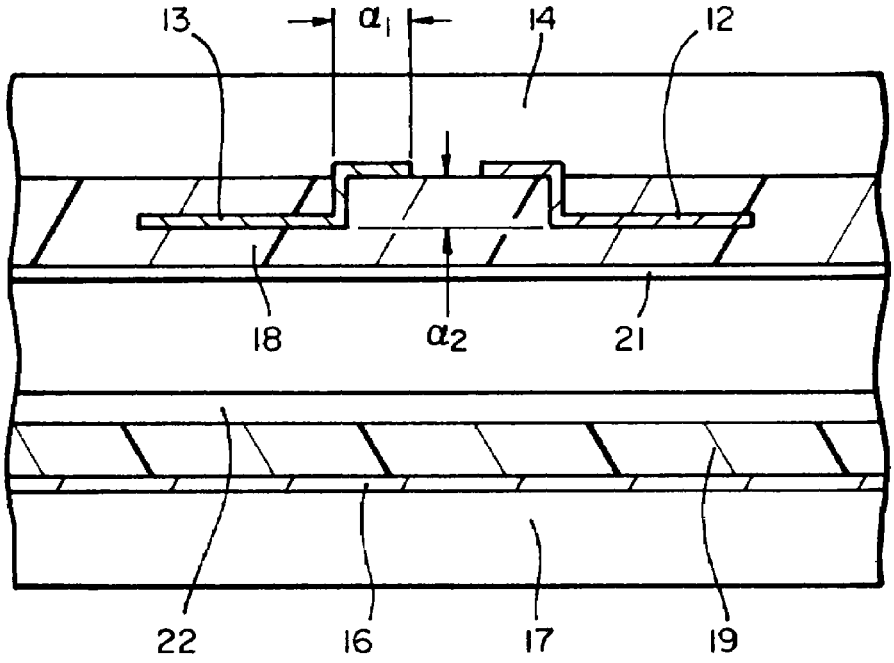
FIG. 5 is a cross-sectional view of a PDP cell in accordance with one embodiment of the invention.

In FIG. 5 we show a PDP cell geometry with modified shape of sustain electrodes which for brevity will heretofore be referred to as the electrode-shaping geometry. This design is characterized by the design parameters $\alpha_1$ and $\alpha_2$. FIG. 4 shows $\eta$ and $V_{Sm}$ for this electrode-shaping geometry with $\alpha_1$=100 μm and $\alpha_2$=22.5 μm, all other parameters being the same as in the reference case. We observe that the mid-margin voltage $V_{Sm}$ is essentially the same as in the reference case, while the luminous efficiency $\eta$ increases by ~16%. If $\alpha_1$ and $\alpha_2$ are kept constant, and the sustain electrode width w is increased from 300 to 400 μm, the increase in the luminous efficiency $\eta$ with respect to the reference case is found to be ~20%, while the operating voltage increases by only a few volts. It should be noted that the substantial increase in $\eta$ for the electrode-shaping geometry, when w is increased, is not observed in the standard coplanar-electrode geometry, as shown in FIG. 4. It should also be noted that for a given cell width L the sustain electrode width w has to be small enough to ensure that no undesired discharges occur with sustain electrodes of adjacent cells. Thus, there is a limit to the increase in efficiency that can be achieved in the electrode-shaping geometry by increasing w.

Figure 2:
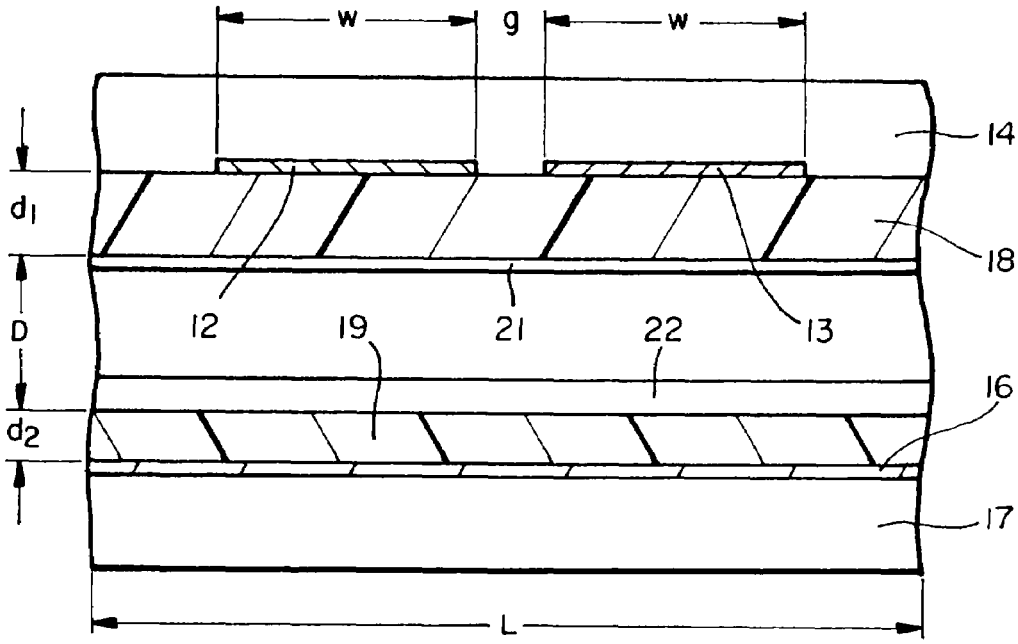
FIG 2 (PRIOR ART)
FIG. 2 is a cross-sectional view of a PDP cell in accordance with the prior art.
Figure 6A:
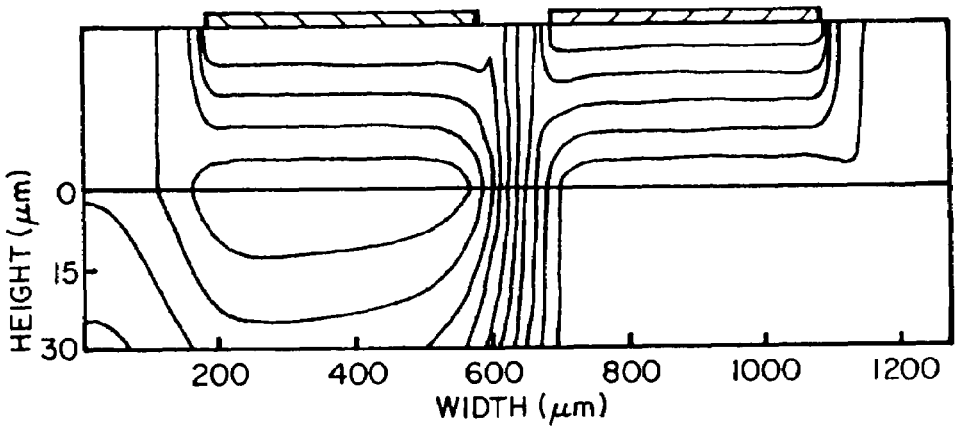
FIGS. 6*a*-6*c* show the calculated equipotenial lines for standard, electrode shaping and dielectric shaping designs of PDP cells.
Figure 6B:
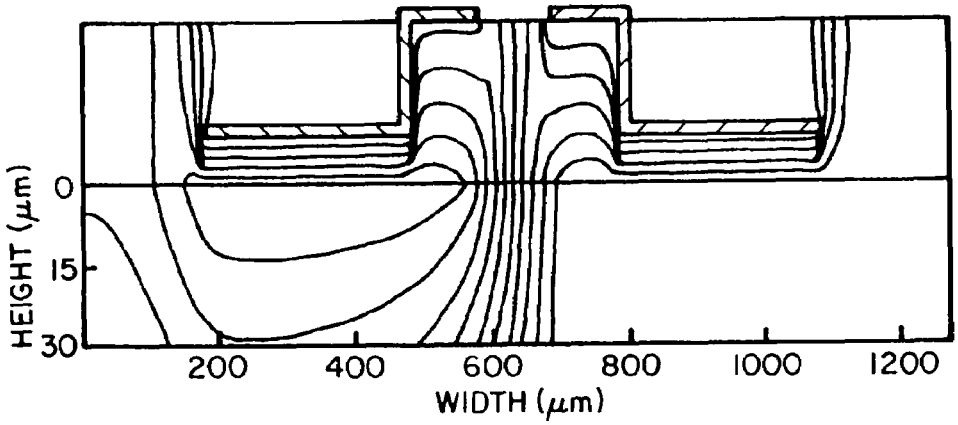

It is obvious from the results presented in FIG. 4 that the electrode-shaping geometry has better performance than the standard coplanar-electrode geometry of FIG. 2. It results in increase in luminous efficiency without substantial increase of the operating voltages. The operating voltages remain the same because the structure in the middle of the cell is the same in both the standard coplanar-electrode and electrode-shaping geometries. FIGS. 6*a* and 6*b* show equipotential lines for the standard and the electrode-shaping geometries respectively. We observe that in both cases the electric field in the gap is maximum in the region between the two sustain electrodes in the cell center. As the applied voltage is increased, the breakdown condition first occurs in discharge paths in this high-field region. We observe that the electric field structure is the same for both designs in the high-field region and that the breakdown voltage is therefore not significantly different. In other words, the different shape of sustaining electrodes of the new structure does not significantly perturb the electric field distribution in the region where breakdown first occurs.

In order to better understand the reasons for the increase in the luminous efficiency, we focus our attention on the excitation efficiency. The luminous efficiency defined in Eq. (1) can also be written as $$\eta=\eta_1\eta_2\eta_3\eta_4,$$

$$\eta_1=\epsilon_{el}/(\epsilon_{el}+\epsilon_{ion}), \tag{2}$$

$$\eta_2=\epsilon_{exc}/\epsilon_{el},$$

$$\eta_3=\epsilon_{UV}/\epsilon_{exc},$$

$$\eta_r=\epsilon_{vis}/\epsilon_{UV},$$

where $\epsilon_{el}$ and $\epsilon_{ion}$ are the total energies dissipated per period by electrons and ions respectively, $\epsilon_{exc}$ is the total energy lost by electrons per period in collisions that lead to the production of UV emitting excited states of xenon, $\epsilon_{UV}$ is the total UV emitted energy per period, and $\epsilon_{vis}$ is the total visible light energy reaching the output window. Physically, $\eta_1$ is the efficiency of the discharge in heating the electrons, $\eta_2$ is the efficiency of electrons in producing UV emitting states of xenon, and $\eta_3$ is the efficiency of emission of UV photons by xenon excited atoms and molecules. Finally, $\eta_4$ is an additional factor in the overall luminous efficiency $\eta$, related to the efficiency of transport of UV photons to the phosphor layer and of the visible photons to the output window, and to the UV-to-visible conversion efficiency of the phosphor. Our analyses indicate that the effect of cell geometry variations on $\eta_3$ is small, because the rates of the reactions that lead to emission of UV photons from xenon excited states are solely determined by the gas mixture composition. Similarly, the effect of cell geometry variations on $\eta_4$ is small. Although we might expect that geometry variations could result in UV emission closer to the phosphor layer, and therefore higher $\eta_4$, the increase in $\eta_4$ is relatively small for the two-dimensional cell geometry variations considered herein. We therefore focus our attention on the excitation efficiency defined as $\eta_{exc}=\eta_1\eta_2$ representing the components of the overall efficiency most significantly affected by geometry variations. The excitation efficiency is therefore given by $$\eta=\frac{\int_T dt\int_V dv\sum_{i=1}^{N_{esc}} n_e v_i^* \varepsilon_{exci}}{\int_T dt\int_V dv\left(J_e+\sum_{i=1}^{N_{ion}} J_{ioni}\right)\cdot E}, \tag{3}$$

where $n_e$ is the electron density, $v_i^*$ is the excitation frequency of excited state of Xe i which leads through a series of reactions to UV photon production, and $\epsilon_{exci}$ is the corresponding electron loss energy.

Figure 7A:
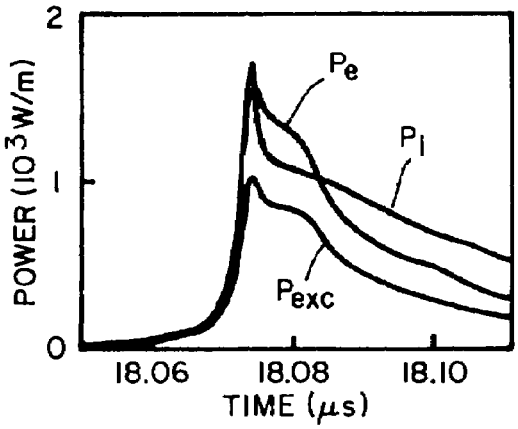
FIGS. 7*a*-7*b* show calculated dissipated ion power, dissipated electron power and power spent on Xe excitation per unit length for standard and electrode shaping geometries.
Figure 7B:
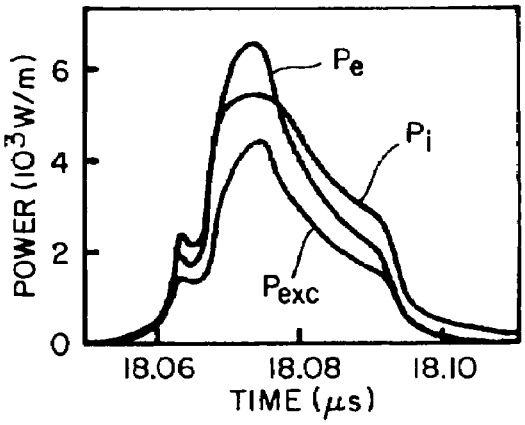

In FIGS. 7*a* and 7*b*, we show the dissipated ion power, dissipated electron power, and power spent on Xe excitation in the PDP cell per unit length of the standard (FIG. 2) and electrode-shaping (FIG. 5) geometries respectively. Results are shown as a function of time, during the discharge caused by the fifth sustain pulse applied to the electrode 13 starting at t=18 μs. We observe that the duration of the discharge is shorter for the electrode-shaping geometry and that the peak power dissipation is higher by almost a factor of 3.

We may note that the excitation efficiency can also be written as $$\eta_{exc}=\int_v dv\left[\int_T dt\frac{p_{exc}}{\varepsilon_{tot}}\right], \tag{4}$$

where $$p_{exc}=\sum_{i=1}^{N_{exc}} n_e v_i^* \varepsilon_{exci}, \text{ and } \varepsilon_{tot}=\int_T dt\int_V dv p, \text{ where } p=\left(J_e+\sum_{i=1}^{N_{ion}} J_{ioni}\right)\cdot E.$$

Figures 7C, 7D:
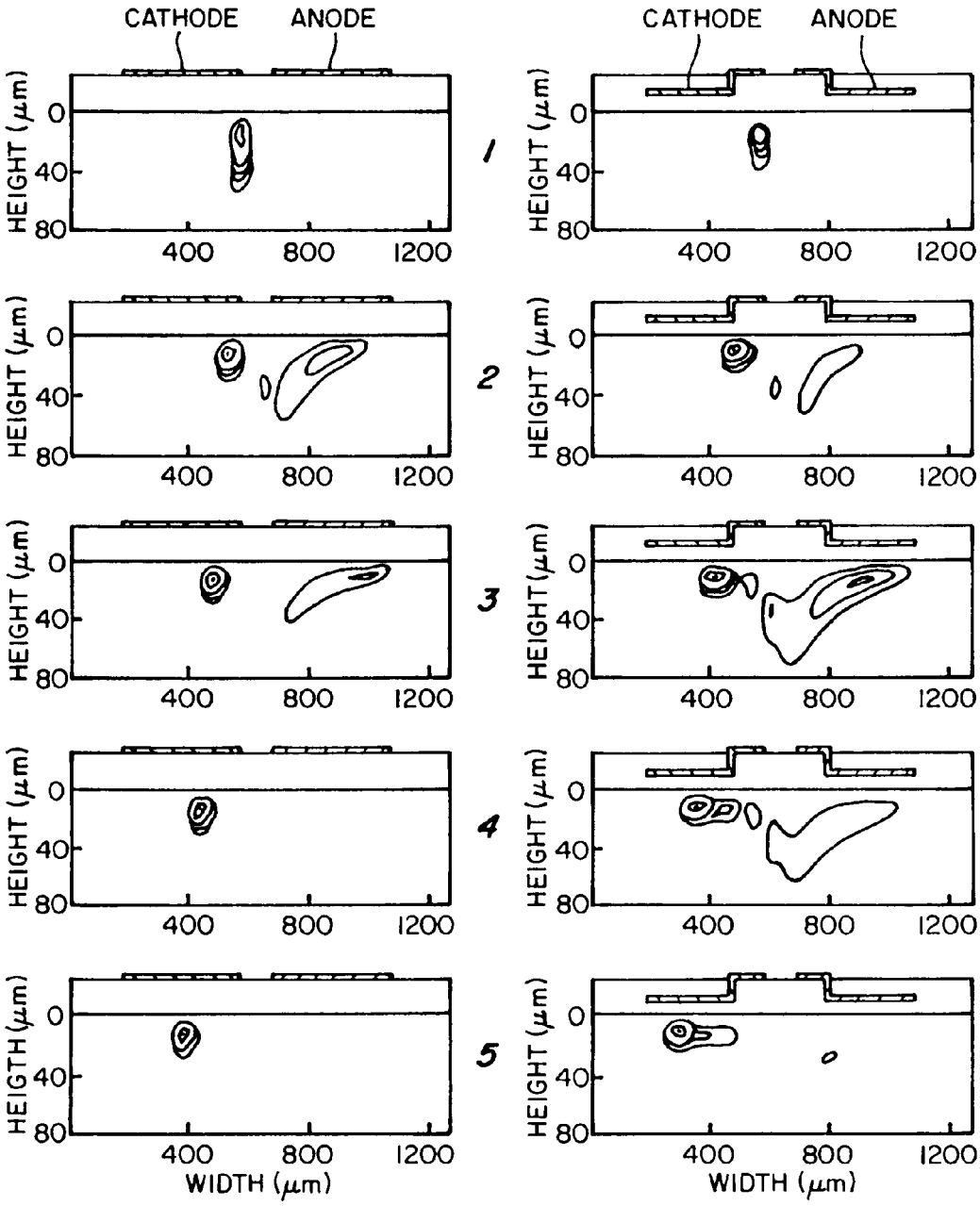
FIGS. 7*c*-7*d* show calculated normalized power spent for xenon excitation integrated over 5 consecutive time intervals for standard and electrode-shaping geometries.
Figure 8:
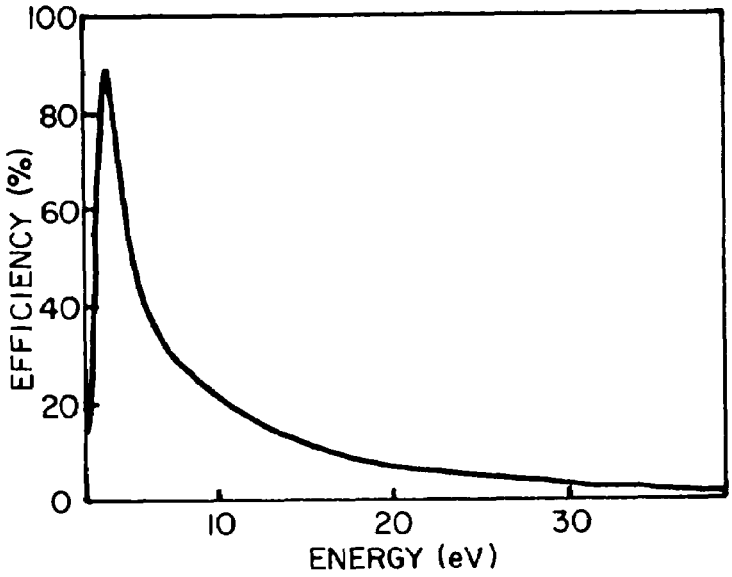
FIG. 8 shows electron excitation efficiency as a function of electron mean energy.

Equation (4) suggests that the excitation efficiency $\eta_{exc}$ is obtained by integrating (over space and time) the power spent for xenon excitation ($p_{exc}$) normalized by the total energy dissipated in the discharge ($\epsilon_{ion}$). For purposes of brevity, this quantity, which is directly related to the excitation efficiency, will heretofore be referred to as the normalized power spent for xenon excitation. In FIGS. 7(*c*) and 7(*d*) we show the normalized power spent for xenon excitation, integrated over 5 ns time intervals, for the standard (FIG. 2) and electrode-shaping (FIG. 5) geometries respectively. We observe that high excitation occurs both in the cathode sheath—plasma interface and in the bulk plasma regions. The bulk plasma excitation region is wider in the electrode-shaping geometry [snapshots 2, 3, 4 of FIGS. 7(*c*), 7(*d*)], for which the outer ends of the sustain electrodes are closer to the gap [FIG. 5] so that the electric field is enhanced in the corresponding gap region. Due to the enhancement of the electric field in the outer parts of the gap, wider discharge paths become increasingly favorable in this new structure. We note that wider plasma region results in higher discharge efficiency. The cathode ion sheath region is characterized by high electric fields and high electron temperatures, while the bulk plasma region is characterized by much lower electric fields and consequently lower electron temperatures. In FIG. 8 we show the calculated electron excitation efficiency $\eta_2$ as a function of electron mean energy, in constant uniform electric fields. We observe that $\eta_2$ is maximized at ~4 eV.

Our analyses indicate that, during the discharge, the electric field is high enough to sustain electron temperatures above this threshold in all regions of significant excitation. Excitation efficiency is therefore a decreasing function of electron temperature for PDP discharge conditions. It is for this reason that the bulk plasma region of the discharge is more efficient than the sheath region and that wider plasma region results in higher efficiency. In addition, we observe that the bulk plasma region in the electrode-shaping geometry is more efficient than the bulk plasma region of the standard structure [snapshots 2 and 3 of FIGS. 7(*c*), 7(*d*)], due to lower electric fields and consequently lower electron temperatures in the bulk plasma region.

Finally, we observe that the cathode sheath region is also more efficient in the electrode-shaping design [snapshots 4 and 5 of FIGS. 7(*c*), 7(*d*)]. Excitation is more confined in the cathode region of the standard structure. As mentioned above, the electric field is higher in the outer part of the gap in the electrode-shaping geometry. Electron temperatures are therefore higher and $\eta_2$ is lower. However, the excitation region in the cathode ion sheath for the electrode-shaping geometry includes a 'tail' region [snapshots 4 and 5 of FIG. 7(*d*)] so that the cathode region is overall more efficient for this new structure. We found that the tail excitation region is due to longer discharge duration in individual discharge paths in the electrode-shaping geometry, because it takes more time to produce (via ionization) the charge required to quench the discharge. For example, in the case presented in FIG. 7, the distance of the outer part of the sustain electrodes from the gap for the electrode-shaping design is 7.5 μm, while that for the standard design is 30 μm. The equivalent capacitance and therefore the charge required to quench the discharge is thus four times larger in the electrode-shaping geometry. Although the electric field in the ion sheath is also much larger in the electrode-shaping geometry, the time required to quench the discharge is longer due to the highly nonlinear saturation effect of the ionization coefficient at high electric fields. The partial covering of the dielectric layer with charge results in a prolonged discharge in a low electric field regime which favors high efficiency, as mentioned above. In summary, the new electrode-shaping geometry (FIG. 5) is more efficient than the standard coplanar-electrode geometry (FIG. 2), because the excitation efficiency is higher in both the cathode ion sheath and the bulk plasma region, and because the more efficient bulk plasma region is wider.

As we noted above, the overall duration of the discharge is shorter in the electrode-shaping geometry [FIGS. 7(*a*)-7(*d*)]. Once the sustain voltage pulse is applied, the time required to reach breakdown is shorter in discharge paths below the outer parts of the sustain electrodes in this new structure, due to the larger overvoltage. Thus, the discharges in individual discharge paths in the electrode-shaping geometry initiate earlier but last longer.

Figure 9:
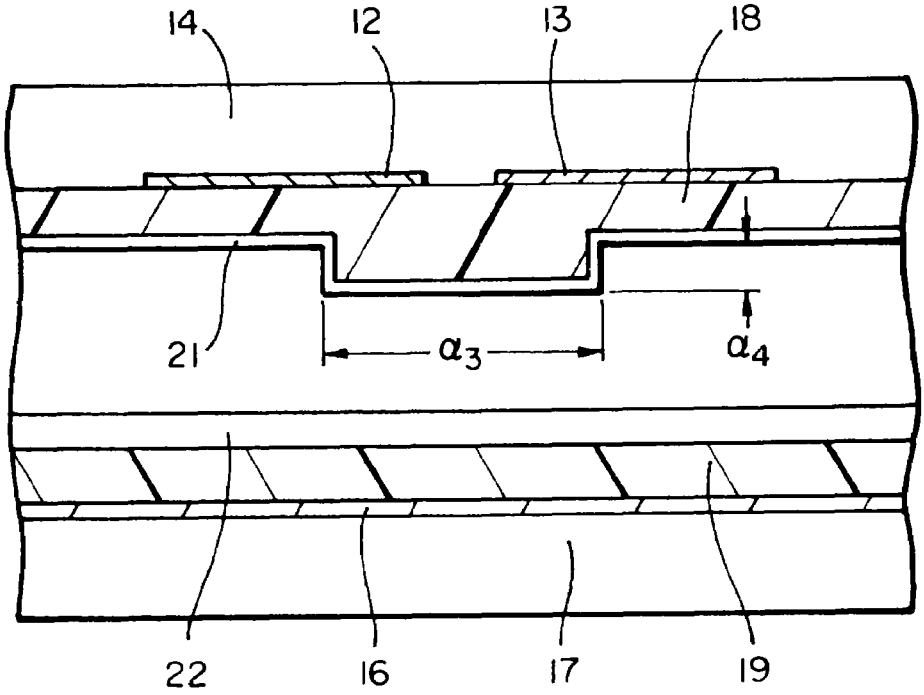
FIG. 9 is a cross sectional view of a PDP cell in accordance with another embodiment of the invention.

In FIG. 9, we show a PDP cell with modified shape of the upper dielectric which for brevity will heretofore be referred as the dielectric-shaping geometry. The dielectric-shaping geometry is characterized by the design parameters $a_3$ and $a_4$. In FIG. 4 we show $\eta$ and $V_{Sm}$ for the dielectric-shaping geometry with $a_3$=260 μm and $a_4$=22.5 μm. All other parameters are the same as in the reference case. We observe that the mid-margin voltage $V_{Sm}$ is essentially the same as in the reference case, while the luminous efficiency $\eta$ increases by ~14%. As in the electrode-shaping geometry, if $a_3$ and $a_4$ are kept constant, and the sustain electrode width w is increased from 300 to 400 μm, the increase in the luminous efficiency $\eta$ with respect to the reference case is found to be ~17%, while once again the operating voltage increases by only a few volts.

Figure 6C:
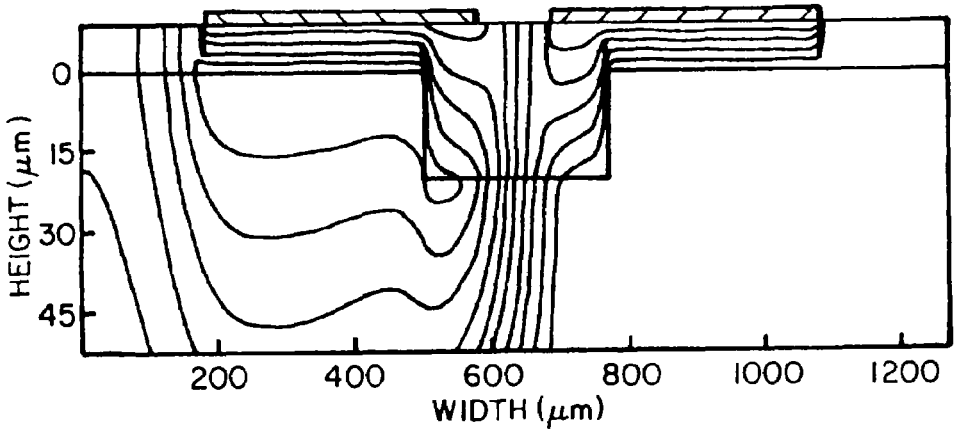
Figure 10A:
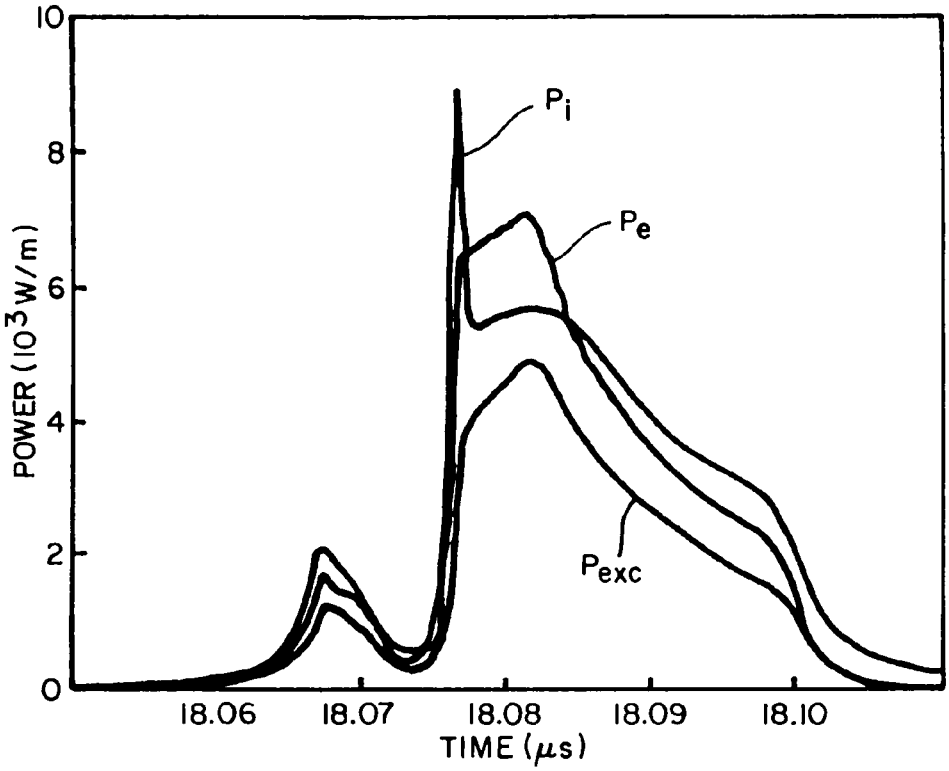
FIG. 10*a* shows calculated dissipated ion power $P_{ion}$, dissipated electron power $P_{el}$, and power spent on Xe excitation $P_{exc}$ per unit length for the dielectric-shaping geometry. (b) Normalized power spent for xenon excitation, integrated over a 5 ns time interval, for the dielectric-shaping geometry.
Figure 10B:
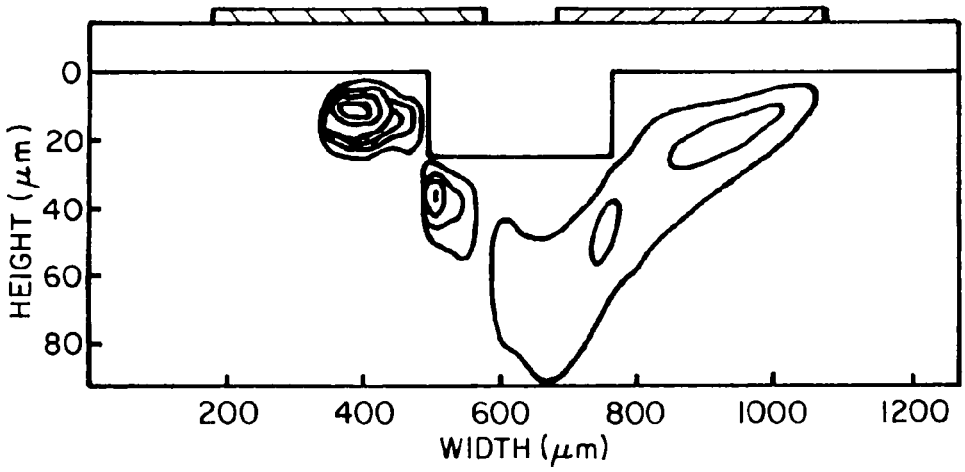
Figure 11A:
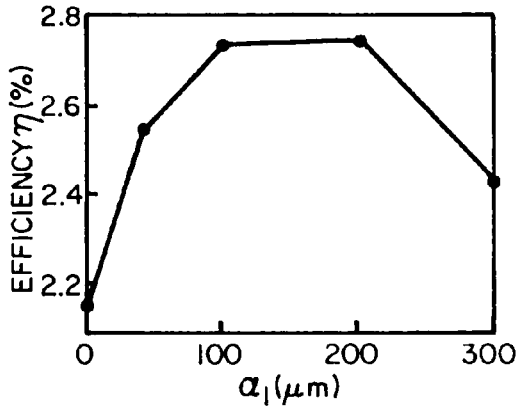
FIG. 11*a* shows calculated luminous efficiency $\eta$ as a function of parameter $\alpha_1$ of the electrode-shaping geometry for $a_2$=20 μm. All other cell parameters are the same as in the reference case. (b) $\eta$ as a function of parameter $\alpha_2$ of the electrode-shaping geometry for $a_1$=100 μm. All other cell parameters are the same as in the reference case. (c) The calculated firing voltage $V_f$ and the minimum sustaining voltage $V_{Smin}$ as a function of $\alpha_1$. The dashed line shows the midmargin sustaining voltage $V_{Sm}$ used for the calculation of the efficiency (d) $V_f$, $V_{Smin}$, and $V_{Sm}$ as a function of $\alpha_2$.
Figure 11B:
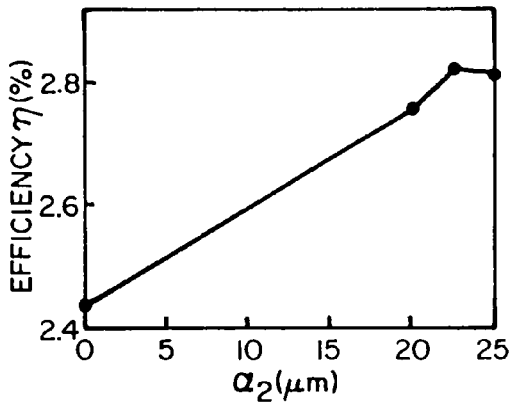
Figure 11C:
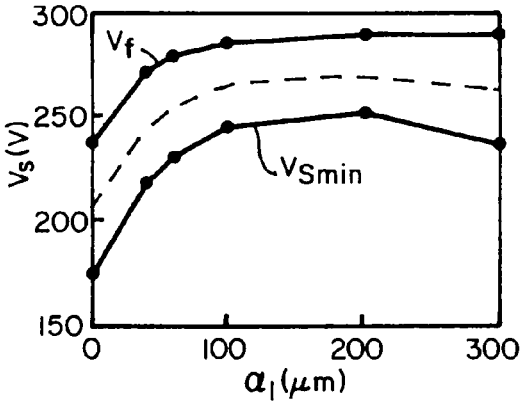
Figure 11D:
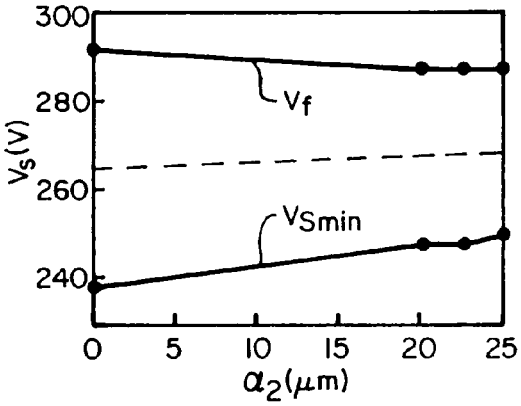

The dielectric-shaping geometry [FIG. 9] has obviously better performance than the standard coplanar-electrode geometry [FIG. 2] and results in larger luminous efficiency without substantial increases of the operating voltages, similarly to the electrode-shaping geometry [FIG. 5]. The similar behavior of the two new structures could be expected, since in both cases the modification in cell design basically results in larger equivalent capacitance of the outer part of the sustain electrodes. We found that the increase in the efficiency without any substantial increase of the operating voltages for the dielectric-shaping geometry can be interpreted in the same way as the improved performance of the electrode-shaping geometry, which was described above in detail. We should nevertheless note two important differences in the performance of these two new structures. First, we observe in FIG. 4 that the electrode-shaping geometry has higher luminous efficiency than the dielectric-shaping geometry. Our analyses indicate that $\eta_4$ is higher for the electrode-shaping design. The region of high excitation and consequently high UV emission directly below the upper dielectric layer is closer to the phosphor layer in the case of the electrode-shaping design, so that more emitted UV photons reach the phosphor. Secondly, in FIG. 10(*a*) we show the dissipated ion power, dissipated electron power, and power spent on Xe excitation in the PDP cell per unit length for the dielectric-shaping geometry. We observe that the peak ionic current is much higher in the dielectric-shaping geometry in comparison with the electrode-shaping geometry. The very large increase in ionic current in the dielectric-shaping geometry is observed when the discharge in the cathode region reaches the point at which the upper dielectric layer length becomes thinner [FIG. 9]. We note that both of the alternative new structures are characterized by points of sharp variation of either the electrode shape [FIG. 5] or the upper dielectric shape [FIG. 9]. The electric field is very large in the vicinity of the sharp points as is shown in the equipotential contours in FIGS. 6(*b*) and 6(*c*) for the electrode-shaping and the dielectric-shaping geometries respectively. However, in the case of the electrode-shaping geometry, the sharp point is inside the dielectric layer so that the increase in the ionic current in the cathode sheath region is not as dramatic as that observed in the dielectric-shaping geometry. Finally, in FIG. 10(*b*), we show the normalized power spent for xenon excitation, integrated over a 5 ns time interval, for the dielectric-shaping geometry for comparison with the standard [FIG. 7(*c*)] and the electrode-shaping geometries [FIG. 7(*d*)].

We now investigate the effect of the design parameters of the new PDP cell structures on the luminous efficiency and the operating voltages of the PDP cell. FIGS. 11(*a*) and 11(*c*) show the dependence of $\eta$, and of $V_f$, $V_{S\ min}$, and $V_{Sm}$, respectively on parameter $a_1$ of the electrode-shaping geometry (FIG. 5). We also note that $a_1=0$ corresponds to a cell design with the sustain electrodes fully inserted in the upper dielectric layer. As expected, analyses indicate that this design has essentially no difference in performance from a standard coplanar-electrode design [FIG. 2] having the same distance of sustain electrodes from the gap. We also note that $a_1=w$ corresponds to the standard coplanar-electrode design. We observe that as $a_1$ is increased, both the efficiency and the operating voltages increase. The efficiency is maximized for $a_1=100$ μm, with any further increases of $a_1$ leading only to increase in the operating voltages. We conclude that the electrode-shaping geometry has better performance than both the standard coplanar-electrode design [FIG. 2] and the equivalent design with the standard sustain electrodes fully inserted in the upper dielectric layer. In addition, for a specific value of $a_2$ there appears to be an optimum value of $a_1$. In FIGS. 11(*b*) and 11(*d*), we show the dependence of $\eta$, and of $V_f$,$V_{S\ min}$, and $V_{Sm}$, respectively on the parameter $a_2$ of the electrode-shaping geometry, noting that $a_2=0$ corresponds to the standard coplanar-electrode design. We observe that the luminous efficiency of the PDP cell increases substantially as $a_2$ is increased, while the operating voltages remain essentially the same. The interpretation of the improved performance of this new structure [FIG. 5] was discussed in detail above. FIG. 11 further shows that the increase in efficiency is maximized for $a_2=22.5$ μm. Analyses indicate that for large values of $a_2$ the efficiency of the discharge in heating the electrons $\eta_1$ is a decreasing function of $a_2$. As $a_2$ is increased, the electric field in the ion sheath region increases and the sheath length decreases. As a result, the efficiency of the discharge in heating the electrons in the sheath region is a decreasing function of $a_2$. This effect dominates for large values of $a_2$ and results in a decrease of $\eta_1$ and subsequently of $\eta$.

Figure 12A:
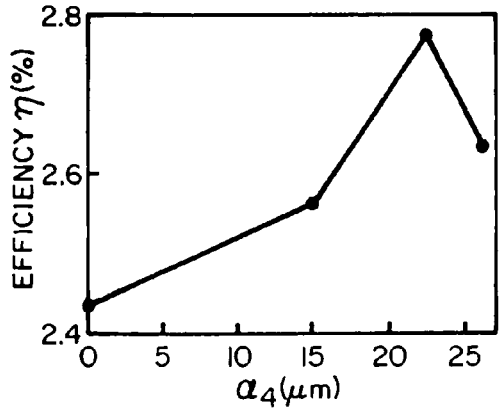
FIG. 12*a* shows luminous efficiency $\eta$ as a function of parameter $\alpha_4$ of the dielectric-shaping geometry for $\alpha_3$=260 μm. All other cell parameters are the same as in the reference case. (b) The firing voltage $V_f$ and the minimum sustaining voltage $V_{Smin}$ as a function of $a_4$. The dashed line shows the midmargin sustaining voltage $V_{Sm}$ used for the calculation of the efficiency.
Figure 12B:
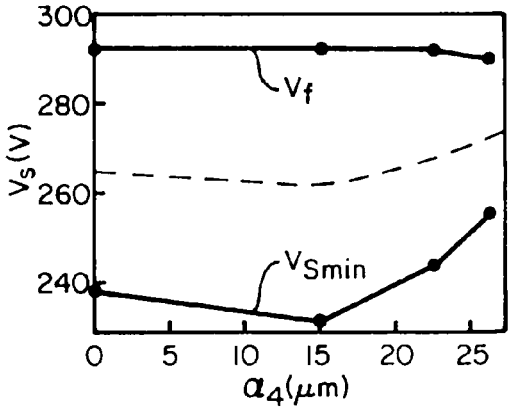

FIGS. 12(*a*) and 12(*b*) show similar results for the dielectric-shaping design. FIGS. 12(*a*) and 12(*b*) show the dependence of $\eta$, and of $V_f$, $V_{S\ min}$, and $V_{Sm}$, respectively on parameter $a_4$ of the dielectric-shaping geometry [FIG. 9]. We observe dependences that are similar to those noted for the electrode-shaping geometry. In both cases, the larger equivalent capacitance of the outer part of the sustain electrodes results in larger luminous efficiency of the PDP cell without significant change in the operating voltages. The increase in the efficiency of the device is maximized for a specific value of the corresponding design parameter in each case for reasons described above.

We note that combination of the two different ways of increasing the equivalent capacitance of the outer part of the sustain electrodes does not result in further increase in efficiency. For example, FIG. 11 shows that the efficiency of the electrode-shaping geometry is maximized for $a_2=22.5$ μm. If the equivalent capacitance is further increased by increasing $a_2$ the efficiency decreases. We verified that, as expected, if the equivalent capacitance is increased, by the dielectric-shaping, the efficiency still decreases.

We used a 2-D self-consistent simulation model to investigate the performance of several non-standard plasma display panel cell geometry designs, by focusing our attention on the operating voltages and the luminous efficiency of PDP cell designs.

The model was used to calculate the voltage margin and the steady state luminous efficiency of PDP cells at their mid-margin sustaining voltage.

A cell design with modified shape of sustain electrodes was found to have ~20% larger luminous efficiency, without substantial increase of the operating voltages, when compared to the standard coplanar-electrode design. A cell design with modified shape of the upper dielectric was found to have ~17% larger luminous efficiency, once again without substantial increase of the operating voltages.

The new geometries are more efficient than the standard coplanar-electrode geometry, because the excitation efficiency is higher in both the cathode ion sheath and the bulk plasma region, and because the more efficient bulk plasma region is wider, due to the increase of the equivalent capacitance of the outer part of the sustain electrodes.

What is claimed is:

1. A plasma display cell comprising front and back plates, a pair of adjacent spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

the thickness of the dielectric layer between each sustaining electrode and the protective layer adjacent the inert gas mixture is thicker in a first region adjacent the discharge gap and thinner in a second region farther away from the same discharge gap within the same display cell, and the dielectric layer in the thicker first region extends over the entire width of the discharge gap and overlaps with the pair of adjacent spaced sustaining electrodes defining the discharge gap;

the electrode configuration of each of the paired sustaining electrodes within the same display cell is step shaped with an outer electrode portion embedded in the dielectric layer, a riser portion, and an inner electrode portion parallel to the outer electrode portion and extending from the riser portion toward the discharge gap defined by the paired sustaining electrodes, and wherein the thickness of dielectric material within the same cell adjacent the inner electrode portion is greater than the thickness of dielectric material adjacent the outer electrode portion; and the thickness of the dielectric material adjacent the inner electrode portion is at least three times the thickness of the dielectric material adjacent the outer electrode portion within the same cell.

2. A plasma display cell as in claim 1 in which the width of the outer electrode portion of the sustaining electrodes is at least two times the width of the inner electrode portion.

3. A plasma display cell as in claim 1 in which the width of the outer electrode portion is at least three times the width of the inner electrode portion.

4. A plasma display cell comprising front and back plates, a pair of adjacent spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

the dielectric layer is patterned to provide a thickness of the dielectric layer between each sustaining electrode and the protective layer adjacent the inert gas mixture which is thicker in a first region adjacent the discharge gap and thinner in a second region farther away from the same discharge gap within the same display cell;

the dielectric layer in the thicker first region extends over the entire width of the discharge gap and overlaps with the pair of adjacent spaced sustaining electrodes defining the discharge gap;

each of the spaced sustaining electrodes is flat and the pair of spaced sustaining electrodes define the discharge gap there between, and the layer of dielectric material adjacent the discharge gap is substantially thicker than the dielectric layer farther away from the same discharge gap on the same front plate; and the thickness of the dielectric layer adjacent the discharge gap is at least three times the thickness of the dielectric layer farther away from the same discharge gap within the same cell.

5. A plasma display cell comprising front and back plates, a pair of adjacent spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

the dielectric layer is patterned to provide a thickness of the dielectric layer between each sustaining electrode and the protective layer adjacent the inert gas mixture which is thicker in a first region adjacent the discharge gap and thinner in a second region farther away from the same discharge gap within the same display cell;

the dielectric layer in the thicker first region extends over the entire width of the discharge gap and overlaps with the pair of adjacent spaced sustaining electrodes defining the discharge gap;

each of the spaced sustaining electrodes is flat and the pair of spaced sustaining electrodes define the discharge gap there between; and the layer of dielectric material adjacent the discharge gap is substantially thicker than the dielectric layer farther away from the same discharge gap on the same front plate; and the width of the thicker portion of the dielectric layer is such that it extends over about one third of the width of the sustaining electrodes.

6. A plasma display including a plurality of cells, each cell comprising front and back plates, a pair of spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

for each of the plurality of cells, the thickness of the dielectric layer between each sustaining electrode and the protective layer adjacent the inert gas mixture is thicker in a first region adjacent the discharge gap and thinner in a second region farther away from the same discharge gap within the same display cell, and the dielectric layer in the thicker first region extends over the entire width of the discharge gap and overlaps with the pair of adjacent spaced sustaining electrodes defining the discharge gap;

the electrode configuration of each of the paired sustaining electrodes within the same display cell is step shaped with an outer electrode portion embedded in the dielectric layer, a riser portion, and an inner electrode portion parallel to the outer electrode portion and extending from the riser portion toward the discharge gap defined by the paired sustaining electrodes, and wherein the thickness of dielectric material within the same cell adjacent the inner electrode portion is greater than the thickness of dielectric material adjacent the outer electrode portion; and the thickness of the dielectric material adjacent the inner electrode portion is at least three times the thickness of the dielectric material adjacent the outer electrode portion within the same cell.

7. A plasma display as in claim 6 in which the width of the outer electrode portion of the sustaining electrodes is at least two times the width of the inner electrode portion.

8. A plasma display as in claim 6 in which the width of the outer electrode portion is at least three times the width of the inner electrode portion.

9. A plasma display as in claim 6 in which the width of the outer electrode portion is less than that which would cause a discharge with the electrode of an adjacent cell.

10. A plasma display including a plurality of cells, each cell comprising front and back plates, a pair of spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

the dielectric layer is patterned to provide a thickness of the dielectric layer between each sustaining electrode and the protective layer adjacent the inert gas mixture which is thicker in a first region adjacent the discharge gap and thinner in a second region farther away from the same discharge gap within the same display cell;

the dielectric layer in the thicker first region extends over the entire width of the discharge gap and overlaps with the pair of adjacent spaced sustaining electrodes defining the discharge gap;

each of the spaced sustaining electrodes is flat and the pair of spaced sustaining electrodes define the discharge gap there between, and the layer of dielectric material adjacent the discharge gap is substantially thicker than the dielectric layer farther away from the discharge gap on the same front plate; and the thickness of the dielectric layer adjacent the discharge gap is at least three times the thickness of the dielectric layer further away from the same discharge gap within the same cell.

11. A plasma display including a plurality of cells, each cell comprising front and back plates, a pair of spaced sustaining electrodes defining a discharge gap there between having a discharge gap width within the same display cell formed at said front plate, a dielectric layer covering said pair of adjacent spaced sustaining electrodes, a protective layer formed on said dielectric layer, an address electrode formed on said back plate, a dielectric layer covering said address electrode, a phosphor layer formed on said dielectric layer, and an inert gas mixture between said protective layer and said phosphor layer, characterized in that:

the dielectric layer is patterned to provide a thickness of the dielectric layer between each sustaining electrode and the protective layer adjacent the inert gas mixture which is thicker in a first region adjacent the discharge gap and thinner in a second region farther away from the same discharge gap within the same display cell;

the dielectric layer in the thicker first region extends over the entire width of the discharge gap and overlaps with the pair of adjacent spaced sustaining electrodes defining the discharge gap;

each of the spaced sustaining electrodes is flat and the pair of spaced sustaining electrodes define the discharge gap there between, and the layer of dielectric material adjacent the discharge gap is substantially thicker than the dielectric layer farther away from the discharge gap on the same front plate; and the width of the thicker portion of the dielectric layer is such that it extends over about one third of the width of the sustaining electrodes.

12. A plasma display as in claim 11, wherein the thickness of the dielectric layer adjacent the discharge gap is at least three times the thickness of the dielectric layer further away from the same discharge gap within the same cell.

* * * * *